US011649134B1

(12) United States Patent
Oshiro

(10) Patent No.: US 11,649,134 B1
(45) Date of Patent: May 16, 2023

(54) SHEET POST-PROCESSING APPARATUS

(71) Applicant: TOSHIBA TEC KABUSHIKI KAISHA, Tokyo (JP)

(72) Inventor: Toshiaki Oshiro, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/898,677

(22) Filed: Aug. 30, 2022

(51) Int. Cl.
*B65H 45/30* (2006.01)
*B65H 29/38* (2006.01)

(52) U.S. Cl.
CPC ..... *B65H 45/30* (2013.01); *B65H 29/38* (2013.01); *B65H 2301/452* (2013.01)

(58) Field of Classification Search
CPC ..... B65H 29/38; B65H 29/46; B65H 37/06; B65H 2301/452; B65H 2301/4505; B41L 43/10; B41L 43/12; B41L 43/06; G03G 2215/00877; G03G 21/1638; G03G 2221/1675; G03G 15/70
USPC ..... 270/37, 58.07; 493/436, 438, 439, 440, 493/442, 443, 444
See application file for complete search history.

(56) References Cited

U.S. PATENT DOCUMENTS 5,769,404 A * 6/1998 Kanou ..... G03G 15/6541 270/37
6,947,684 B2 * 9/2005 Fujii ..... G03G 15/6538 399/407
6,957,810 B2 * 10/2005 Yamada ..... G03G 15/6573 270/58.08
7,635,121 B2 * 12/2009 Dobashi ..... B65H 43/02 270/32
7,862,024 B2 * 1/2011 Taguchi ..... B65H 43/06 270/32
11,001,467 B2 * 5/2021 Hanamoto ..... B65H 23/048
2008/0315489 A1 * 12/2008 Iguchi ..... B65H 29/52 270/58.08
2011/0136644 A1 * 6/2011 Kawaguchi ..... G03G 21/1661 493/419
2017/0066620 A1 * 3/2017 Arai ..... G03G 15/6582
2022/0214638 A1 * 7/2022 Fukasawa ..... B42B 4/00
2022/0348433 A1 * 11/2022 Mats ..... B65H 45/18

FOREIGN PATENT DOCUMENTS

JP 2009-58763 3/2009
JP 2012-30963 2/2012
JP 2012-91926 5/2012

* cited by examiner

*Primary Examiner* — Leslie A Nicholson, III
(74) *Attorney, Agent, or Firm* — Amin, Turocy & Watson, LLP

(57) ABSTRACT

According to one embodiment, a sheet post-processing apparatus includes a guide member, a matching member, a post-processing mechanism, a support member, and a drive unit. The guide member has a loading surface on which a sheet is loaded in a standing state. The matching member supports a lower end of the sheet loaded on the guide member in a free raising and lowering manner. The post-processing mechanism performs post-processing on the sheet. The support member supports the matching member. The drive unit raises and lowers the support member. The matching member is configured to be raised and lowered with respect to the support member.

20 Claims, 9 Drawing Sheets

SHEET POST-PROCESSING APPARATUS

FIELD

Embodiments described herein relate generally to a sheet post-processing apparatus.

BACKGROUND

A sheet post-processing apparatus performs post-processing on a sheet transported from an image forming apparatus (for example, an MFP). For example, the sheet post-processing apparatus includes a folding mechanism for bundling a plurality of sheets and folding the sheets in half. When a sheet jam occurs in the sheet post-processing apparatus, a user pulls out a frame. The user opens a part of a sheet transport path by pulling out the frame, and removes a jammed sheet.

However, an operation of removing the sheet may not be easily performed in the sheet post-processing apparatus.

DETAILED DESCRIPTION

According to one embodiment, a sheet post-processing apparatus includes a guide member, a matching member, a post-processing mechanism, a support member, and a drive unit. The guide member has a loading surface on which a sheet is loaded in a standing state. The matching member supports a lower end of the sheet loaded on the guide member in a free raising and lowering manner. The post-processing mechanism performs post-processing on the sheet. The support member supports the matching member. The drive unit raises and lowers the support member. The matching member is configured to be raised and lowered with respect to the support member.

Hereinafter, the sheet post-processing apparatus according to the embodiment will be described with reference to the drawings.

Figure 1:
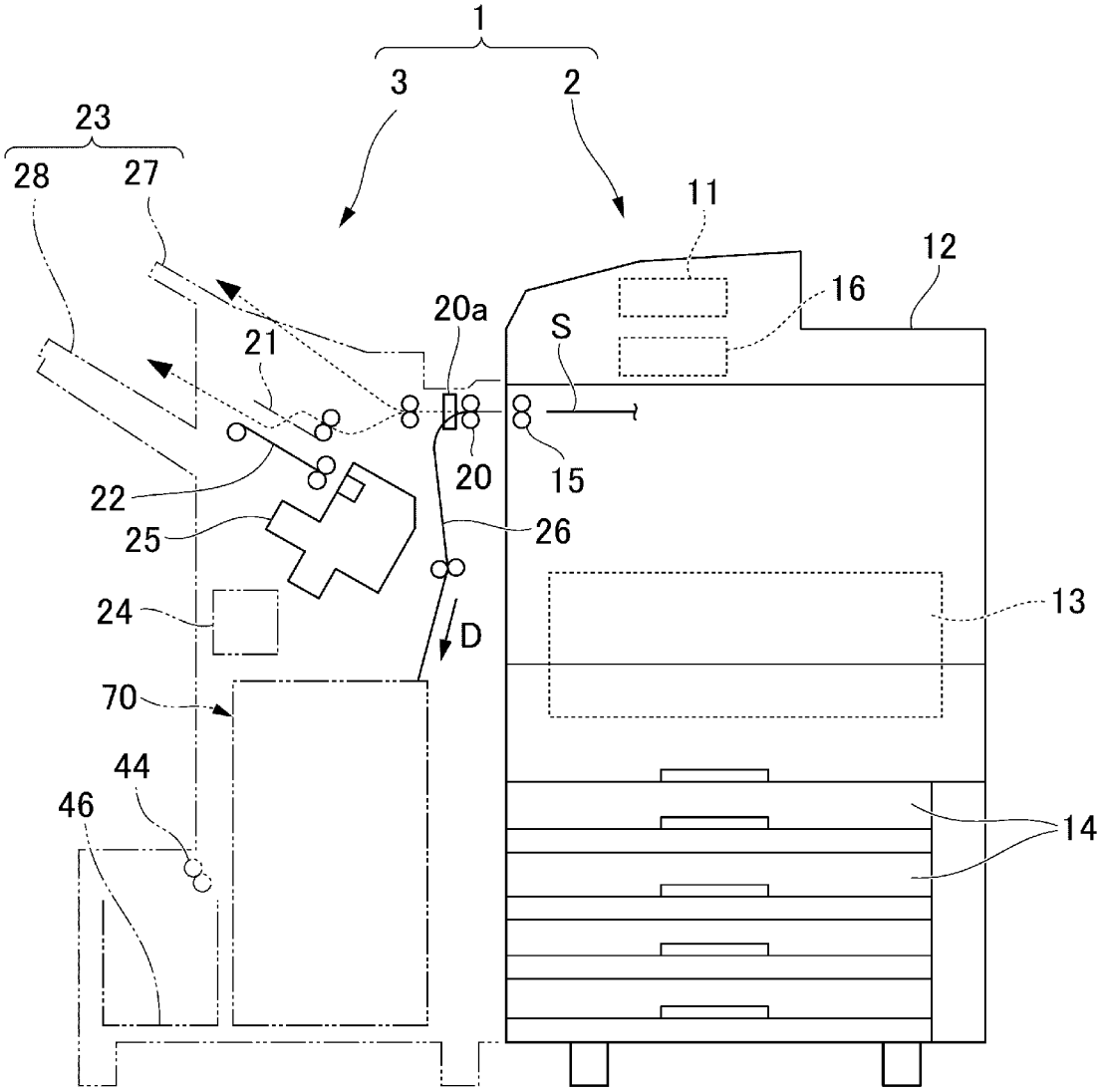
FIG. 1 is a diagram showing an example of an image forming system according to an embodiment.

FIG. 1 is a diagram showing an example of an image forming system 1 according to the embodiment.

As shown in FIG. 1, the image forming system 1 includes an image forming apparatus 2 and a sheet post-processing apparatus 3. The sheet post-processing apparatus 3 is simply referred to as a "post-processing apparatus 3". For example, the image forming apparatus 2 is disposed in a workplace.

The image forming apparatus 2 forms an image on a sheet-shaped recording medium such as paper. The recording medium is referred to as "sheet S". For example, the image forming apparatus 2 is a multi-function peripherals (MFP) which is a multifunction device, a printer, a copier, or the like. The post-processing apparatus 3 performs the post-processing on the sheet S transported from the image forming apparatus 2. The sheet S is not limited to paper, and includes a plastic sheet such as an overhead projector (OHP) sheet. The sheet S may be supplied from the image forming apparatus 2 to the post-processing apparatus 3 or may be manually supplied to the post-processing apparatus 3.

Figure 2:
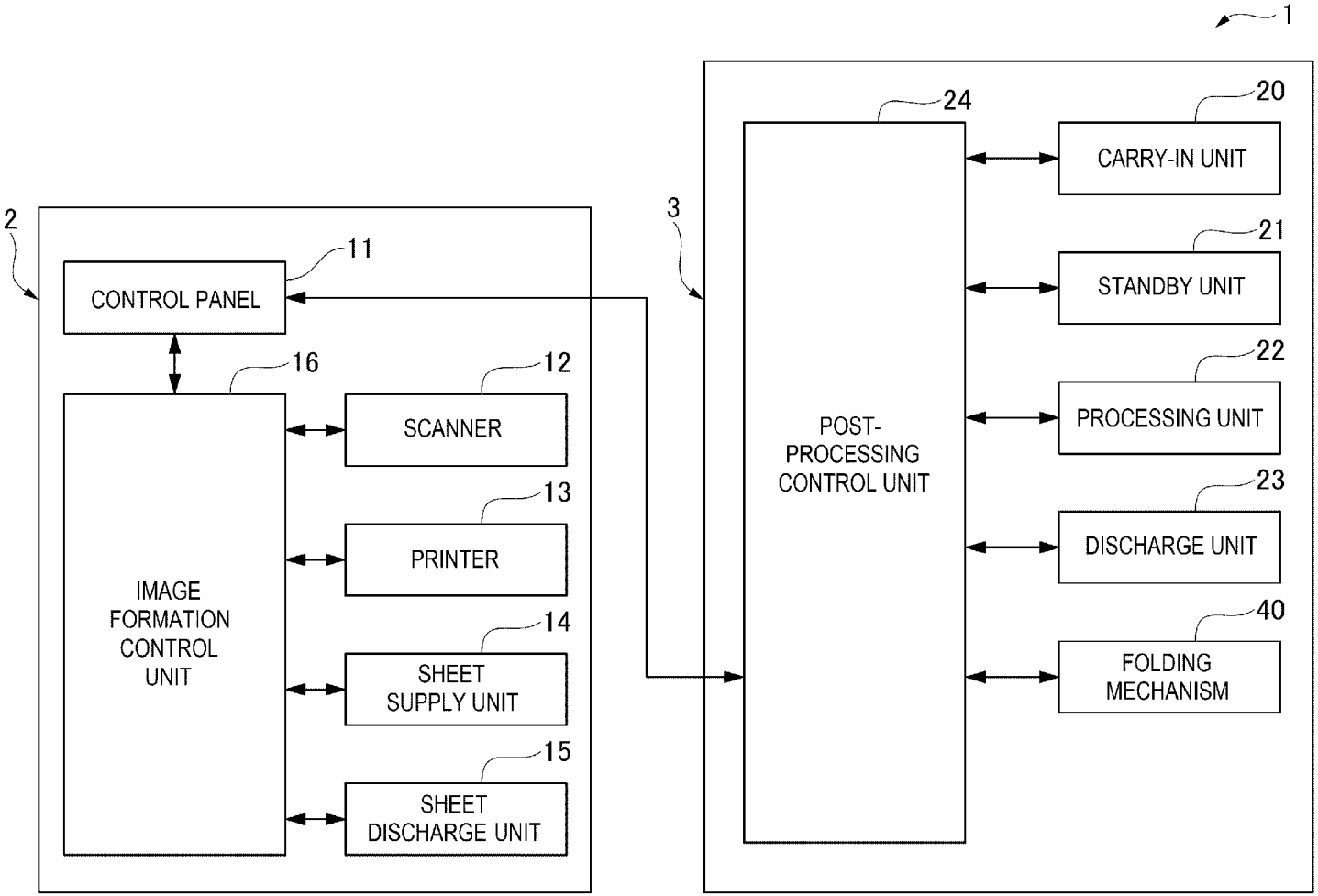
FIG. 2 is a block diagram showing a configuration of the image forming system according to the embodiment.

FIG. 2 is a block diagram showing a configuration of the image forming system 1 according to the embodiment.

As shown in FIG. 2, the image forming apparatus 2 includes a control panel 11, a scanner 12, a printer 13, a sheet supply unit 14, a sheet discharge unit 15, and an image formation control unit 16.

The control panel 11 includes various keys, a touch panel, and the like that receive an operation by a user. For example, the control panel 11 receives an input related to a type of the post-processing on the sheet S. The image forming apparatus 2 transmits information related to the type of the post-processing to the post-processing apparatus 3.

The scanner 12 includes a reading unit that reads image information of an object to be copied. The scanner 12 transmits the read image information to the printer 13.

The printer 13 forms an output image by a developer such as toner based on the image information transmitted from the scanner 12 or an external device. The output image is a "toner image". The printer 13 transfers the toner image onto a surface of the sheet S. The printer 13 applies heat and a pressure to the toner image transferred onto the sheet S to fix the toner image on the sheet S.

The sheet supply unit 14 supplies the sheet S to the printer 13 one by one in accordance with a timing when the printer 13 forms the toner image.

The sheet discharge unit 15 transports the sheet S discharged from the printer 13 to the post-processing apparatus 3.

The image formation control unit 16 controls an overall operation of the image forming apparatus 2. The image formation control unit 16 controls the control panel 11, the scanner 12, the printer 13, the sheet supply unit 14, and the sheet discharge unit 15. The image formation control unit 16 includes a control circuit including a central processing unit (CPU), a read only memory (ROM), and a random access memory (RAM).

Next, the post-processing apparatus 3 will be described.

As shown in FIG. 1, the post-processing apparatus 3 is adjacent to the image forming apparatus 2. The image forming apparatus 2 transports the sheet S to the post-processing apparatus 3. The post-processing apparatus 3 executes the post-processing specified via the control panel 11 on the transported sheet S. For example, the post-processing apparatus 3 performs sheet folding of folding the sheet in half for discharging. For example, the post-processing apparatus 3 may perform stapling and sorting.

The post-processing apparatus 3 includes a carry-in unit 20, a standby unit 21, a processing unit 22, a discharge unit 23, a post-processing control unit 24 (control unit), a folding mechanism 40 (see FIG. 3), a stacker 50 (see FIG. 3), a drive mechanism 60 (see FIG. 3), a frame 70, a staple unit 80 (see FIG. 3), a pair of discharge rollers 44, and a sheet discharge tray 46.

The carry-in unit 20 is connected to a downstream side in a transport direction of the sheet discharge unit 15. The carry-in unit 20 receives the sheet S transported from the image forming apparatus 2.

The standby unit 21 temporarily retains the sheet S transported from the image forming apparatus 2. The standby unit 21 is located above the processing unit 22. When the processing unit 22 is empty, the standby unit 21 causes the retained sheet S to fall down toward the processing unit 22.

The processing unit 22 performs the post-processing on the transported sheet S. For example, the processing unit 22 performs the sorting of aligning and matching a plurality of sheets S. For example, the processing unit 22 performs sheet binding by a staple or an adhesive tape on a sheet bundle in which the plurality of sheets S are aligned. In the figure, a reference numeral 25 denotes a sheet binding device that performs binding by a staple or the like on the sheet bundle in the processing unit 22. The processing unit 22 discharges the sheet S subjected to the post-processing to the discharge unit 23.

The discharge unit 23 includes a fixed tray 27 and a movable tray 28. The fixed tray 27 is located on an upper portion of the post-processing apparatus 3. The movable tray 28 is located on a side portion of the post-processing apparatus 3. The sheet S is discharged to the fixed tray 27 and the movable tray 28.

As shown in FIG. 2, the post-processing control unit 24 controls an overall operation of the post-processing apparatus 3. That is, the post-processing control unit 24 controls operations of the carry-in unit 20, the standby unit 21, the processing unit 22, the discharge unit 23, and the folding mechanism 40. Similar to the image formation control unit 16, the post-processing control unit 24 includes a control circuit including a CPU, an ROM, and an RAM.

Figure 3:
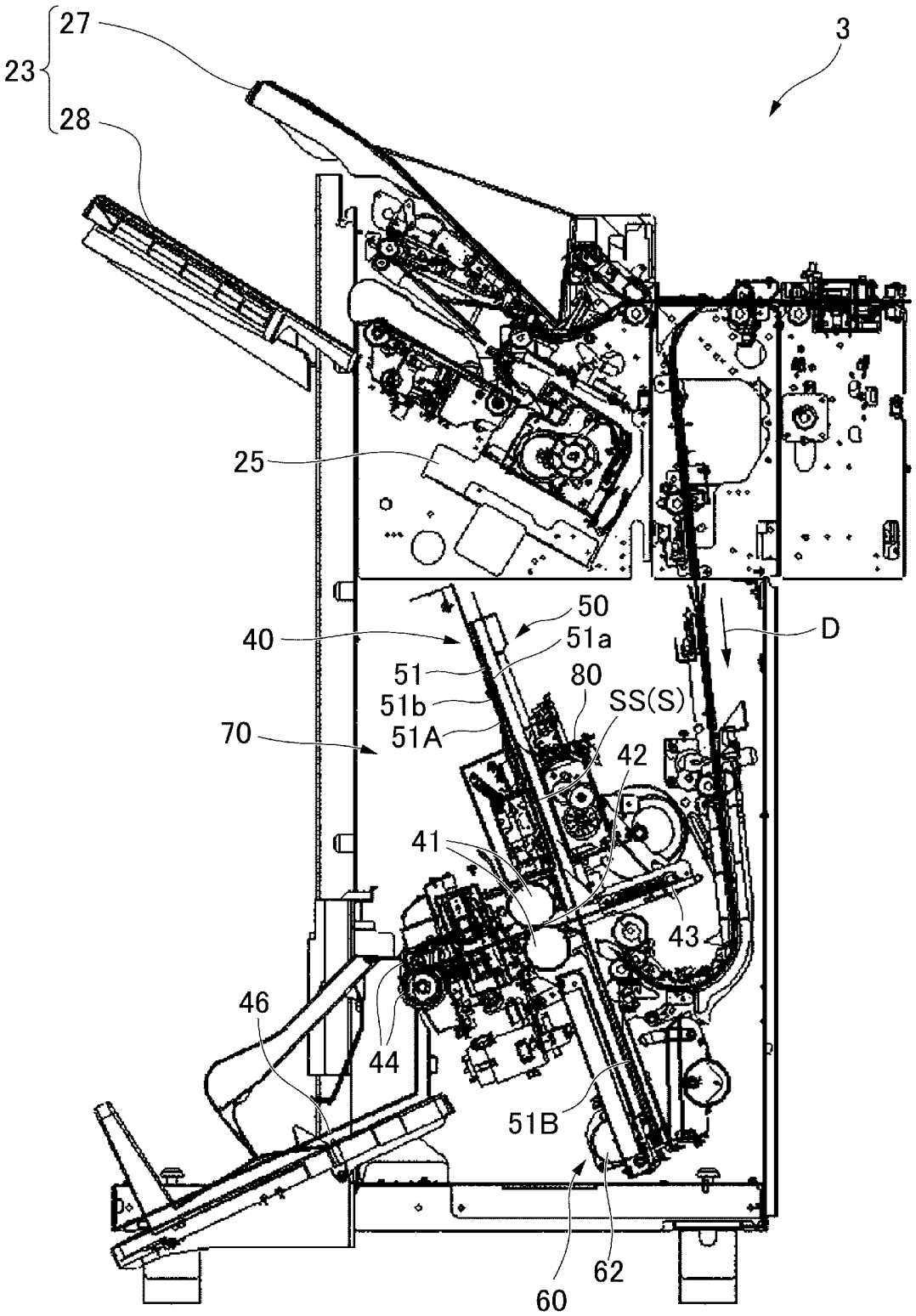
FIG. 3 is a configuration diagram of a sheet post-processing apparatus according to the embodiment.

FIG. 3 is a configuration diagram of the post-processing apparatus 3.

As shown in FIG. 3, the folding mechanism 40 folds one or a plurality of sheets S in half. In the present embodiment, a sheet bundle SS implemented by a plurality of sheets S is folded in half. For example, the number of the sheets S forming the sheet bundle SS is 2 to 30. A direction along a transport path of the sheet S supplied to the folding mechanism 40 is a sheet transport direction D. The sheet transport direction D is also simply referred to as a "transport direction". A direction perpendicular to a paper surface of FIG. 3 is a sheet width direction. The folding mechanism 40 is an example of the post-processing mechanism.

The folding mechanism 40 includes a pair of folding rollers 41 and a blade 43.

The pair of folding rollers 41 is generally located at positions facing a surface of a guide member 51 opposite to a loading surface 51*a*. The pair of folding rollers 41 form a nip portion 42. For example, the folding rollers 41 are rubber rollers. One of the pair of folding rollers 41 is a drive roller. The other of the pair of folding rollers 41 is a driven roller.

The sheet bundle SS is sandwiched in the nip portion 42 of the folding rollers 41 by the blade 43. The folding rollers 41 fold the sheet bundle SS inserted into the nip portion 42 in half, and send the sheet bundle SS that is folded in half to the downstream side.

The blade 43 is a plate-shaped member. The blade 43 is located at a position facing the nip portion 42 of the folding rollers 41. The blade 43 has a length in a direction orthogonal to the loading surface 51*a* of the guide member 51.

The blade 43 can reciprocate in a direction approaching and away from the nip portion 42 of the folding rollers 41. The blade 43 enters the nip portion 42 while pushing a center position of the sheet bundle SS into the nip portion 42. The blade 43 leaves the sheet bundle SS in the nip portion 42 and retracts from the nip portion 42.

Figure 6:
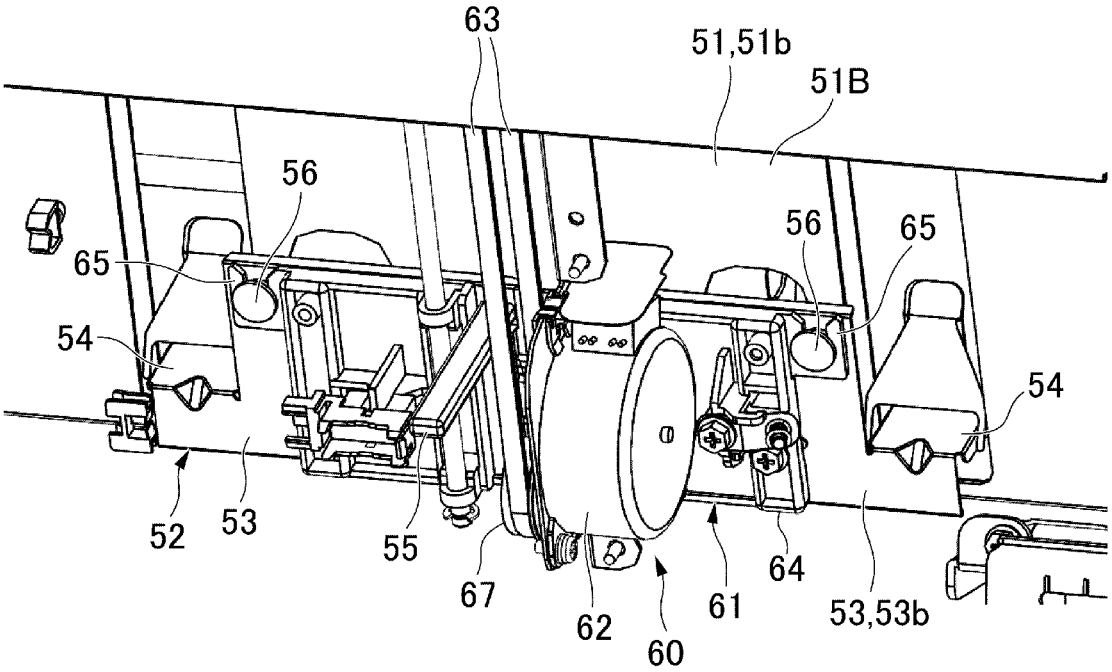
FIG. 6 is a perspective view of a part of the sheet post-processing apparatus according to the embodiment.

The stacker 50 includes the guide member 51 and a matching member 52 (see FIG. 6). The guide member 51 has a flat plate shape. A surface of the guide member 51 on a side opposite to the surface facing the folding rollers 41 is the loading surface 51*a*. The loading surface 51*a* is a surface on which the sheet bundle SS is loaded in a standing state. The guide member 51 takes an upright posture inclined with respect to a vertical direction (up-down direction in FIG. 3). The guide member 51 is inclined in a direction approaching the image forming apparatus 2 (see FIG. 1) as the guide member 51 goes downward. The guide member 51 is inclined such that the loading surface 51*a* faces obliquely upward. A back surface 51*b* of the guide member 51 is the surface opposite to the loading surface 51*a*. A facing direction of the loading surface 51*a* is "forward". A facing direction of the back surface 51*b* is "rearward".

The guide member 51 includes a first guide plate 51A and a second guide plate 51B. The first guide plate 51A is located at a position higher than the second guide plate 51B. Between the first guide plate 51A and the second guide plate 51B, there is a gap from and into which the blade 43 can advance and retract.

As shown in FIG. 6, the matching member 52 is provided on the second guide plate 51B. The matching member 52 supports a lower end of the sheet loaded on the loading surface 51*a*.

Figure 7:
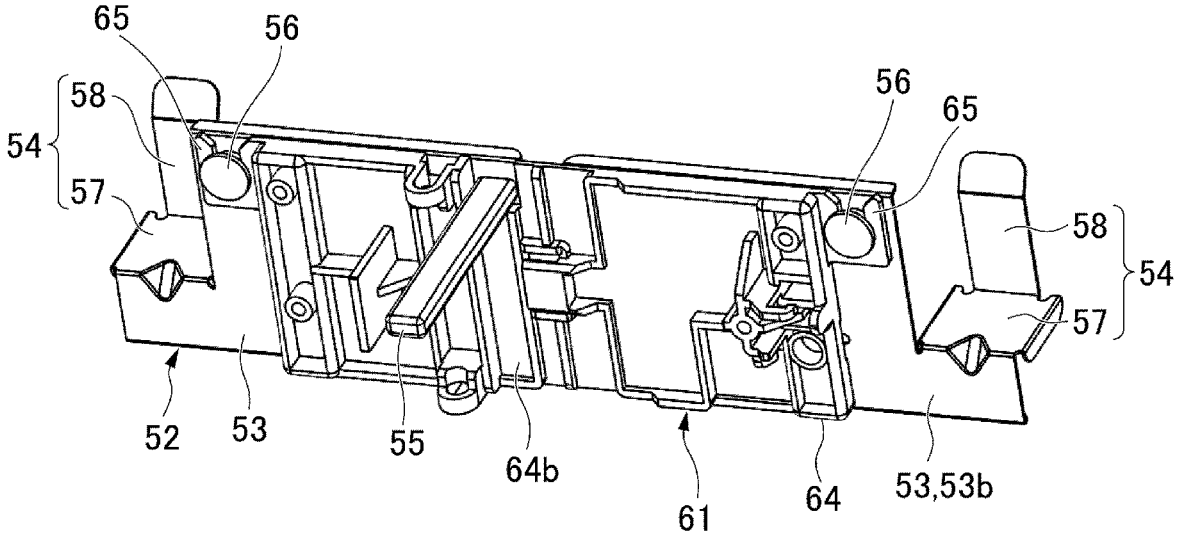
FIG. 7 is a perspective view of a matching member and a support member.
Figure 8:
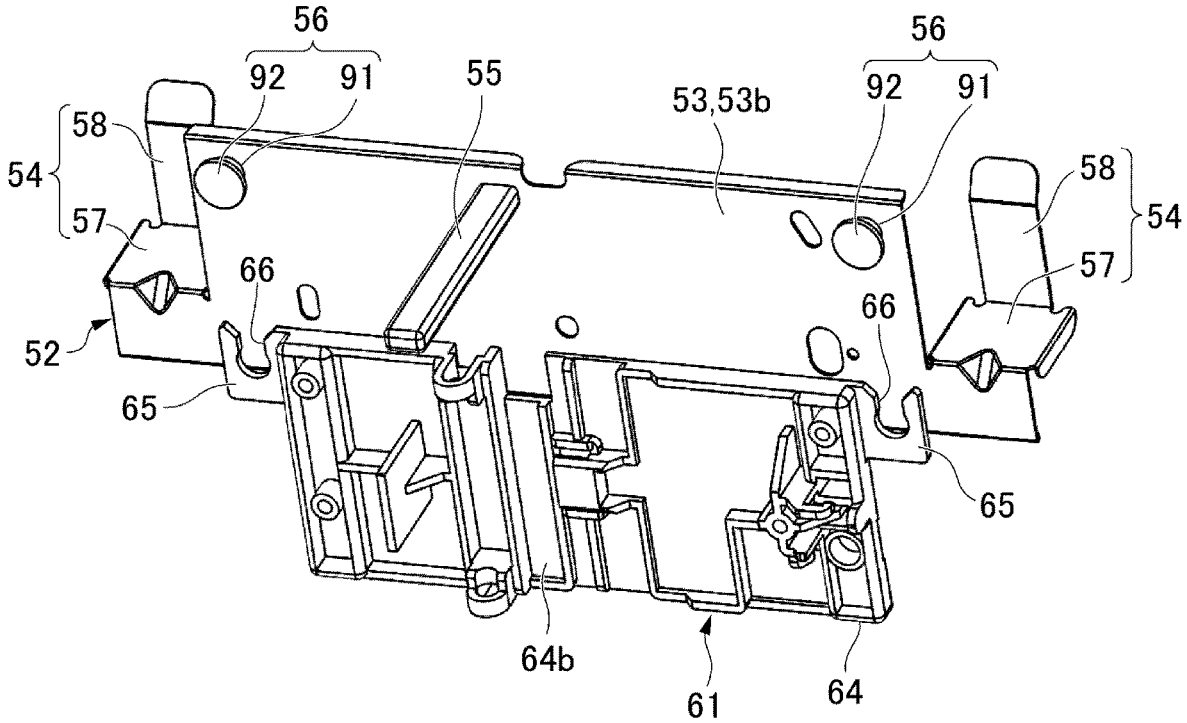
FIG. 8 is a perspective view of the matching member and the support member.

As shown in FIGS. 7 and 8, the matching member 52 includes a back plate portion 53, one or a plurality of receiving portions 54, an operation portion 55, and one or a plurality of engagement portions 56. The back plate portion 53 is superposed on the back surface 51*b* (see FIG. 6) of the guide member 51. The back plate portion 53 has a shape having a length in the sheet width direction.

In the present embodiment, the number of the receiving portions 54 is two. The two receiving portions 54 are formed at an interval in the sheet width direction. One of the receiving portions 54 is formed at one end portion of the back plate portion 53. The other of the receiving portions 54 is formed at the other end portion of the back plate portion 53.

The receiving portion 54 includes a receiving plate portion 57 and a claw portion 58. The receiving plate portion 57 protrudes forward from the back plate portion 53. The receiving plate portion 57 protrudes forward from the loading surface 51*a* (see FIG. 3) of the guide member 51. The receiving plate portion 57 supports the lower end of the sheet loaded on the loading surface 51*a*. The claw portion 58 protrudes upward from a tip end of the receiving plate portion 57. The claw portion 58 restricts forward movement of the sheet supported by the receiving plate portion 57.

The operation portion 55 protrudes rearward from a back surface 53*b* of the back plate portion 53 (see FIG. 8). The operation portion 55 is formed on an upper portion of the back plate portion 53 at a center in a length direction. The operation portion 55 has a stick shape that linearly protrudes from the back plate portion 53. In a state in which a support member 61 is attached to the matching member 52 (see FIG. 7), the operation portion 55 protrudes further toward a back surface side (rearward) than a back surface 64*b* of a main plate portion 64 of the support member 61.

In the present embodiment, the number of the engagement portions 56 is two. The two engagement portions 56 are formed at an interval in the sheet width direction. One of the engagement portions 56 is formed in an upper portion in the vicinity of one end portion of the back surface 53*b* of the back plate portion 53. The other of the engagement portions 56 is formed in an upper portion in the vicinity of the other end portion of the back surface 53*b* of the back plate portion 53.

As shown in FIG. 8, the engagement portion 56 includes a shaft portion 91 and a restriction portion 92. The shaft portion 91 protrudes rearward from the back surface 53*b* of the back plate portion 53. For example, the shaft portion 91 has a cylindrical shape having a central axis perpendicular to the back surface 53*b*. The shaft portion 91 is inserted into a recess 66 of an engagement receiving portion 65 and is engaged with the engagement receiving portion 65.

The restriction portion 92 is formed at a tip end of the shaft portion 91. For example, the restriction portion 92 has a disk shape parallel to the back surface 53*b*. An outer dimension (outer diameter) of the restriction portion 92 is larger than an outer diameter of the shaft portion 91. The restriction portion 92 restricts the engagement receiving portion 65 from moving rearward (in a direction away from the back plate portion 53).

As shown in FIG. 6, the drive mechanism 60 includes the support member 61, a drive unit 62, and a transmission belt 63.

The support member 61 includes the main plate portion 64 and one or a plurality of engagement receiving portions 65. The support member 61 supports the matching member 52. The main plate portion 64 is a rectangular plate having a length in the sheet width direction. The main plate portion 64 is superposed on the back surface 53*b* of the back plate portion 53. The support member 61 is a separate member from the matching member 52.

As shown in FIG. 8, in the present embodiment, the number of the engagement receiving portions 65 is two. The engagement receiving portion 65 has a plate shape along the main plate portion 64. One of the engagement receiving portions 65 protrudes outward from an end edge of one end portion of the main plate portion 64. The other of the engagement receiving portions 65 protrudes outward from an end edge of the other end portion of the main plate portion 64. The "outward" is a direction in which the one end portion and the other end portion of the main plate portion 64 are separated from each other.

The engagement receiving portion 65 has the recess 66 formed upward. The recess 66 has a recessed shape downward from an upper end of the engagement receiving portion 65. A width of the recess 66 is equal to or larger than the outer diameter of the shaft portion 91. The width of the recess 66 is smaller than the outer dimension (outer diameter) of the restriction portion 92.

The recess 66 may have a shape including a base portion and a wide portion having a width larger than that of the base portion. The wide portion is located at a position lower than the base portion. When the recess 66 including the base portion and the wide portion is employed, since the shaft portion 91 is disposed in the wide portion, the engagement portion 56 is less likely to be detached from the recess 66.

The shaft portions 91 of the engagement portions 56 are inserted into the recesses 66 by being lowered with respect to the engagement receiving portions 65. When the shaft portions 91 are inserted into the recesses 66, the matching member 52 is attached to the support member 61. The shaft portions 91 are removed from the recesses 66 by being raised with respect to the engagement receiving portions 65. When the shaft portions 91 are removed from the recesses 66, the matching member 52 is detached from the support member 61.

Since the matching member 52 can be detached from the support member 61, the matching member 52 can be raised and lowered with respect to the support member 61. For example, the matching member 52 can be raised and lowered in a plane parallel to the support member 61. The matching member 52 can be located at an optional height position independently of the support member 61.

Figure 11:
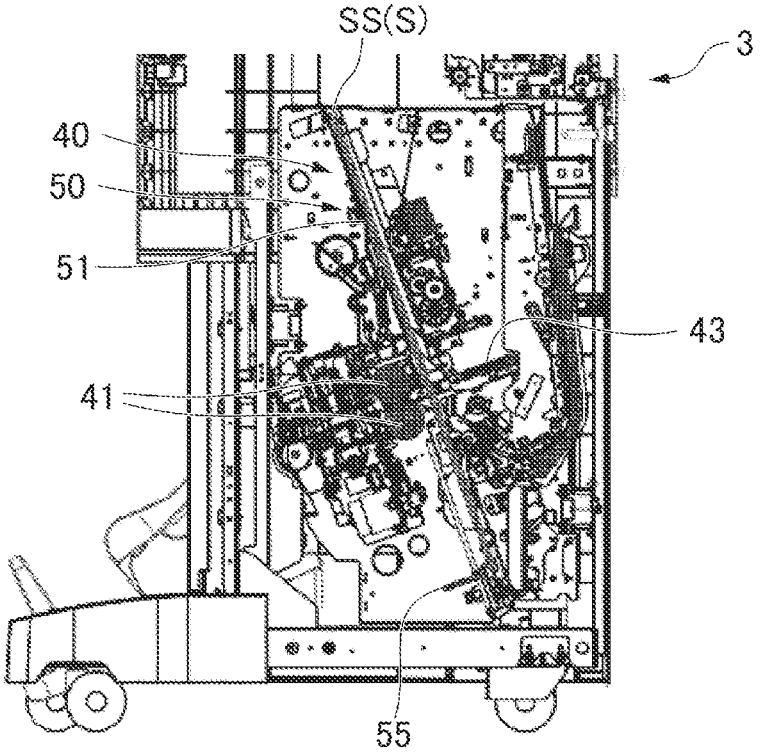
FIG. 11 is a configuration diagram of a part of the sheet post-processing apparatus according to the embodiment.

As shown in FIG. 7, when the matching member 52 is at the lowermost position with respect to the support member 61, the shaft portions 91 are inserted into the recesses 66, and the matching member 52 is attached to the support member 61. A position of this matching member 52 (position shown in FIG. 7) is referred to as a "normal position". For example, as shown in FIG. 11, when the matching member 52 is in the normal position, an upper end of the sheet bundle SS is located at a position the same as an upper surface of the frame 70 or a position lower than the upper surface of the frame 70. The sheet bundle SS supported by the matching member 52 is located in the frame 70.

Figure 12:
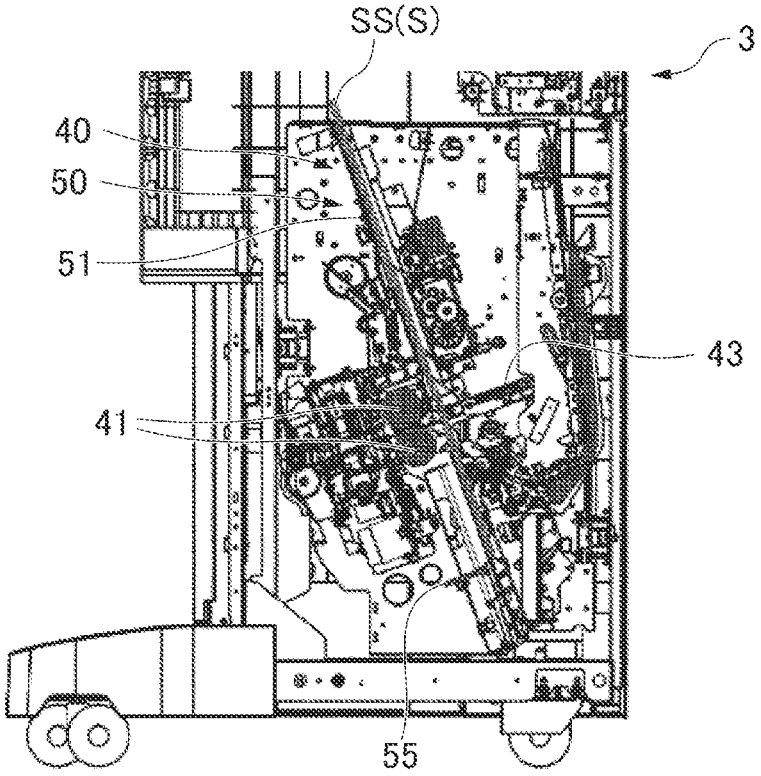
FIG. 12 is a configuration diagram of an example of the sheet post-processing apparatus according to the embodiment.

As shown in FIG. 12, the matching member 52 may be located in a "raised position" higher than the normal position without changing a height position of the support member 61. When the matching member 52 is at the raised position, a part of the sheet bundle SS supported by the matching member 52 protrudes to the outside of the frame 70. For example, a portion including the upper end of the sheet bundle SS protrudes upward from the upper surface of the frame 70.

As shown in FIGS. 11 and 12, the matching member 52 can switch between the normal position and the raised position. For example, the matching member 52 can be moved from the normal position to the raised position by lifting the operation portion 55 and raising the matching member 52. The matching member 52 can be moved from the raised position to the normal position by lowering the matching member 52 by an operation of the operation portion 55.

As shown in FIG. 6, the drive unit 62 is provided on the back surface side of the main plate portion 64. For example, the drive unit 62 is a motor. The drive unit 62 transmits a driving force to the transmission belt 63 via a pulley 67. The transmission belt 63 is formed in an endless shape. The transmission belt 63 is wound around the pulley 67. A part of the transmission belt 63 is attached to the main plate portion 64. The drive unit 62 can raise and lower the support member 61 and the matching member 52 by moving the transmission belt 63. The matching member 52 and the support member 61 are integrally raised and lowered in a state of being engaged with each other. The matching member 52 and the support member 61 can adjust a folding position of the sheet S by the folding mechanism 40 by setting the height position.

As shown in FIG. 3, the pair of discharge rollers 44 are located downstream in the transport direction with respect to the folding rollers 41. One of the pair of discharge rollers 44 is a drive roller. The other of the pair of discharge rollers 44 is a driven roller. The sheet bundle SS (folded body)

transported by the folding rollers 41 is sandwiched in the nip portion of the discharge rollers 44. The discharge rollers 44 transport the folded body inserted into the nip portion.

The sheet discharge tray 46 is located downstream in the transport direction with respect to the discharge rollers 44. The sheet discharge tray 46 loads the folded body transmitted from the discharge rollers 44.

Figure 5:
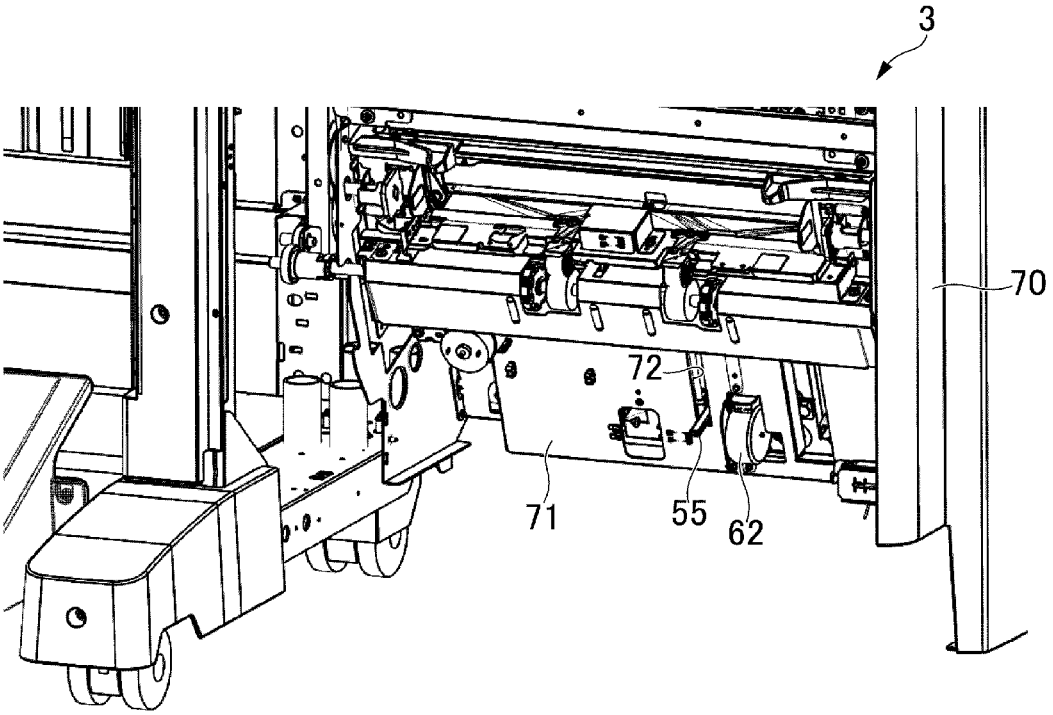
FIG. 5 is a perspective view of a part of the sheet post-processing apparatus according to the embodiment.
Figure 9:
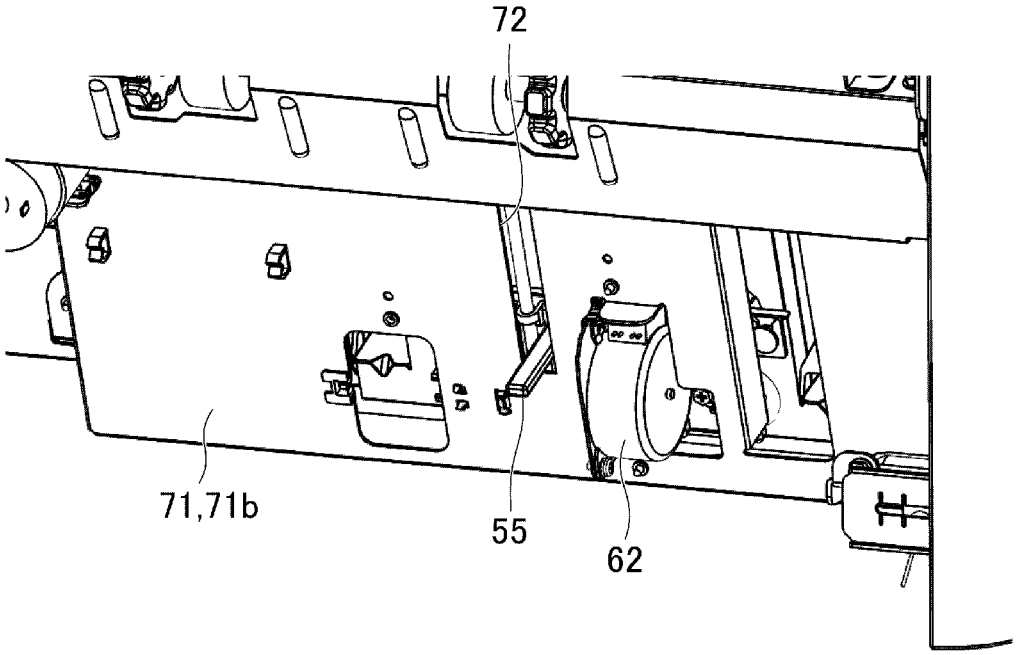
FIG. 9 is a perspective view of a part of the sheet post-processing apparatus according to the embodiment.

The frame 70 includes the folding mechanism 40, the stacker 50, and the drive mechanism 60. As shown in FIG. 5 and FIG. 9, the frame 70 includes a back plate 71 on the back surface side of the support member 61 and the guide member 51. A slit 72 through which the operation portion 55 is inserted is formed in the back plate 71. The slit 72 extends along the up-down direction. The slit 72 allows raising and lowering of the operation portion 55. A portion including a tip end of the operation portion 55 protrudes rearward from the back plate 71.

The staple unit 80 can perform the stapling on the sheet bundle SS before the sheet bundle SS is transmitted to the folding mechanism 40.

As shown in FIG. 1, a gate 20*a* is provided downstream of the carry-in unit 20 of the post-processing apparatus 3. The gate 20*a* switches a transport destination of the sheet S to one of the processing unit 22 and the folding mechanism 40. When the sheet folding is not performed, the gate 20*a* transports the sheet S to the standby unit 21. When the sheet folding is performed, the gate 20*a* transports the sheet S to the folding mechanism 40.

The sheet S transmitted from the image forming apparatus 2 is supplied via a sheet path 26. The staple unit 80 can perform the stapling on a sheet bundle including a plurality of sheets S.

As shown in FIG. 3, the sheet bundle SS supplied to the folding mechanism 40 is loaded on the loading surface 51*a* of the stacker 50. The center position of the sheet bundle SS (center position in the sheet transport direction) faces the nip portion 42 of the folding rollers 41.

The blade 43 pushes out the center position of the sheet bundle SS toward the nip portion 42 of the folding rollers 41. The blade 43 pushes the center position of the sheet bundle SS into the nip portion 42. The blade 43 retracts after the sheet bundle SS is pushed into the nip portion 42. The folding rollers 41 rotate while sandwiching the sheet bundle SS and fold the sheet bundle SS in half.

The sheet bundle SS folded in half is transmitted to the nip portion of the discharge rollers 44 and transported by the discharge rollers 44. The sheet bundle SS folded in half is the "folded body". The discharge rollers 44 transport the folded body. The folded body is discharged to the sheet discharge tray 46.

Next, a method of removing a jammed sheet when a sheet jam occurs in the post-processing apparatus 3 will be described.

Figure 4:
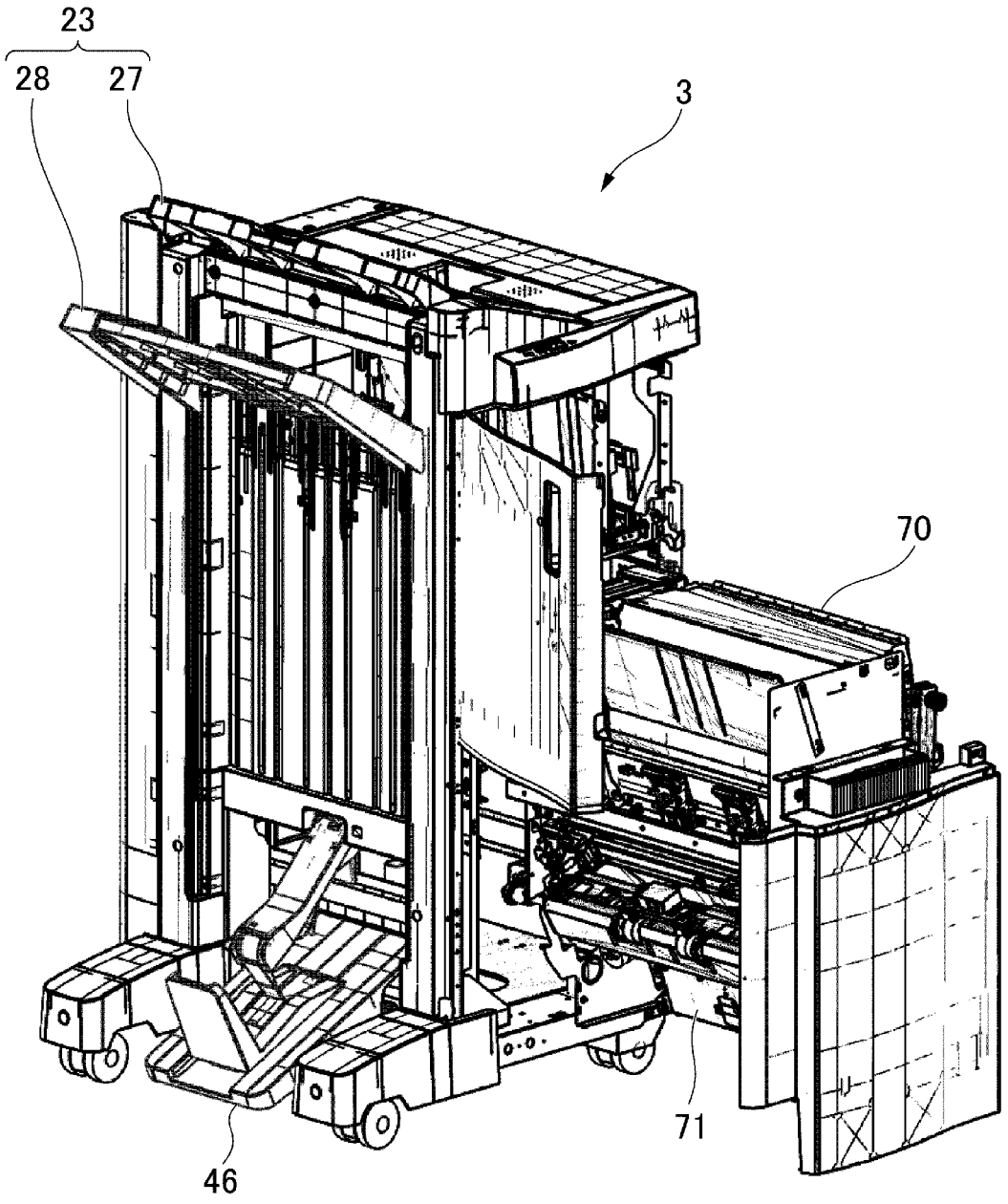
FIG. 4 is a perspective view of the sheet post-processing apparatus according to the embodiment.
Figure 10:
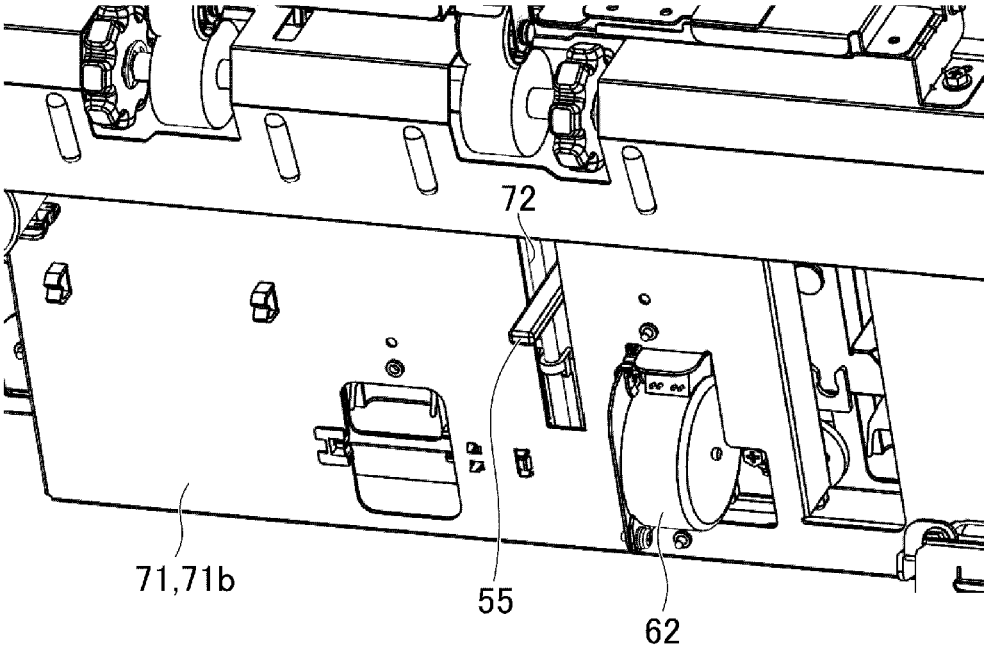
FIG. 10 is a perspective view of the part of the sheet post-processing apparatus according to the embodiment.

As shown in FIG. 4, the frame 70 is pulled out from the post-processing apparatus 3. As shown in FIG. 5 and FIG. 9, the back plate 71 is exposed by pulling out the frame 70. As shown in FIG. 10, the user operates the operation portion 55 to raise the matching member 52. For example, the user can raise the matching member 52 by lifting the operation portion 55 with a finger. As shown in FIG. 12, the matching member 52 is switched to the raised position from the normal position. At this time, the support member 61 does not raise.

When the matching member 52 is at the raised position, the portion including the upper end of the sheet bundle SS protrudes upward from the frame 70. The user can grip the portion including the upper end of the sheet bundle SS and remove the sheet bundle SS from the frame 70.

In the post-processing apparatus 3 of the present embodiment, the matching member 52 can be raised and lowered with respect to the support member 61. By setting the matching member 52 to the raised position, a part of the sheet bundle SS can be protruded from the frame 70 (see FIG. 12). In the post-processing apparatus 3, the jammed sheet bundle SS can be easily removed.

Since the matching member 52 can be switched between the normal position and the raised position (see FIG. 11 and FIG. 12), an operation of protruding a part of the sheet bundle SS from the frame 70 is easy.

Since the support member 61 includes the main plate portion 64 that is superposed on the back plate portion 53, a dimension of the support member 61 in a thickness direction can be reduced, which is advantageous in terms of miniaturization of a device.

When the matching member 52 is raised, the engagement portions 56 are removed from the engagement receiving portions 65, and when the matching member 52 is lowered, the engagement portions 56 are engaged with the engagement receiving portions 65, so that the matching member 52 is easily attached to and detached from the support member 61.

Since the engagement portion 56 include the shaft portion 91 inserted into the recess 66 of the engagement receiving portion 65 and the restriction portion 92 having a diameter larger than that of the shaft portion 91, the engagement receiving portion 65 can be restricted from moving rearward (in the direction away from the back plate portion 53). With this configuration, the matching member 52 is stably attached to the support member 61.

Since the matching member 52 includes the operation portion 55, the operation of raising and lowering the matching member 52 with respect to the support member 61 is easy.

In the post-processing apparatus 3 of the embodiment, the matching member 52 and the support member 61 have a structure in which the engagement portions 56 are engaged with the recesses 66 of the engagement receiving portions 65, but an engagement structure between the engagement portions and the engagement receiving portions is not particularly limited. For example, the matching member 52 may include the engagement receiving portion. The support member 61 may include the engagement portion to be engaged with the recess.

In the post-processing apparatus 3 of the embodiment, the matching member 52 is attached to and detached from the support member 61 by engagement and disengagement between the engagement portions 56 and the engagement receiving portions 65, but the structure for attaching and detaching the matching member 52 and the support member 61 is not particularly limited. For example, the matching member 52 and the support member 61 may be attached to and detached from each other by using attraction of a magnet. For example, the matching member 52 and the support member 61 may be attached to and detached from each other by a concavo-convex fitting structure.

As shown in FIG. 3, in the post-processing apparatus 3 of the embodiment, the guide member 51 is inclined in the direction approaching the image forming apparatus 2 (see FIG. 1) as the guide member 51 goes downward, but an inclination direction of the guide member 51 is not particularly limited. For example, the guide member 51 may be inclined in a direction away from the image forming apparatus 2 (see FIG. 1) as the guide member 51 goes downward.

Figure 13:
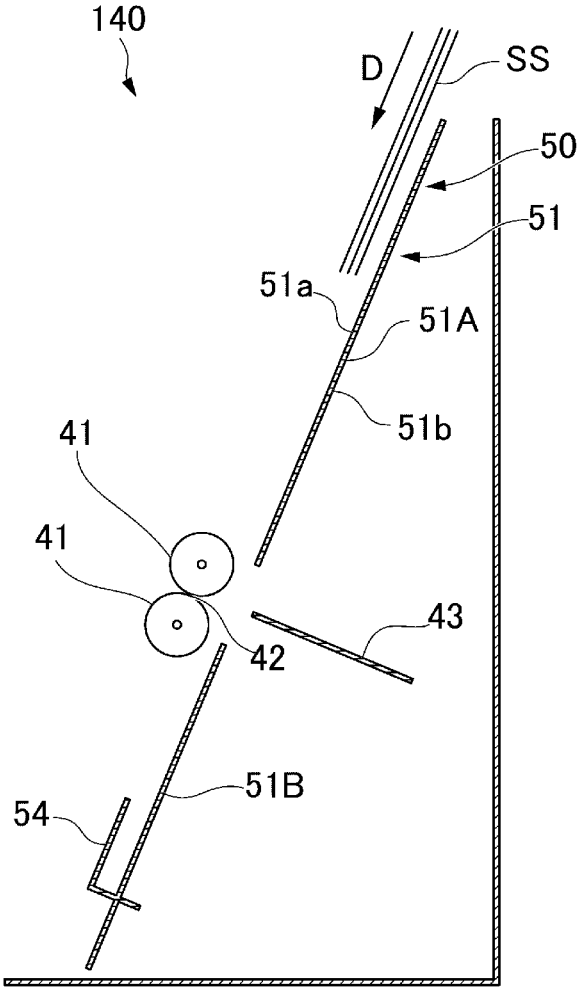
FIG. 13 is a configuration diagram of another example of a folding mechanism.

FIG. 13 is a configuration diagram of another example of the folding mechanism. In this folding mechanism 40, the guide member 51 is inclined in the direction away from the image forming apparatus 2 (see FIG. 1) as the guide member 51 goes downward.

In the post-processing apparatus 3 of the embodiment, the folding mechanism 40 is exemplified as the post-processing mechanism, but the post-processing mechanism is not limited to the folding mechanism. The post-processing mechanism may be a staple unit that performs stapling.

As shown in FIG. 8, in the post-processing apparatus 3 of the embodiment, the number of the receiving portions 54, the engagement portions 56, and the engagement receiving portions 65 is two, but the number thereof is not particularly limited. The number of the receiving portion 54, the engagement portion 56, and the engagement receiving portion 65 may be one, or may be two or more. In the post-processing apparatus 3 of the embodiment, the number of the operation portion 55 is one, but the number of the operation portion 55 is not particularly limited. The number of the operation portions 55 may be two or more. Although the post-processing apparatus 3 includes the discharge roller 44 in the embodiment, the post-processing apparatus may not include the discharge roller.

According to at least one of the embodiments described above, the matching member 52 can be raised and lowered with respect to the support member 61. By setting the matching member 52 to the raised position, a part of the sheet bundle SS can be protruded from the frame 70 (see FIG. 12), so that a jammed sheet bundle SS can be easily removed.

While certain embodiments have been described these embodiments have been presented by way of example only, and are not intended to limit the scope of the embodiments. Indeed, the novel embodiments described herein may be embodied in a variety of other forms: furthermore various omissions, substitutions and changes in the form of the embodiments described herein may be made without departing from the spirit of the disclosure. The accompanying claims and there equivalents are intended to cover such forms or modifications as would fall within the scope and spirit of the disclosure.

What is claimed is:

1. A sheet post-processing apparatus, comprising:

a guide member having a loading surface on which a sheet is loaded in a standing state;

a matching member configured to support a lower end of the sheet loaded on the guide member in a free raising and lowering manner;

a post-processing mechanism configured to perform post-processing on the sheet;

a support member configured to support the matching member; and a drive component configured to raise and lower the support member, wherein the matching member is configured to be raised and lowered with respect to the support member.

2. The sheet post-processing apparatus according to claim 1, wherein the post-processing mechanism includes:

a pair of folding rollers, and a blade configured to fold the sheet in half by pushing the sheet supported by the matching member into a nip portion of the folding rollers.

3. The sheet post-processing apparatus according to claim 2, wherein the matching member is configured to switch between a normal position at which a folding operation of the sheet by the blade is executable and a raised position higher than the normal position.

4. The sheet post-processing apparatus according to claim 3, further comprising:

a frame on which the guide member, the matching member, the folding rollers, the blade, the support member, and the drive component are mounted, wherein when the matching member is at the normal position, the sheet supported by the matching member is located in the frame, and when the matching member is at the raised position, a portion including an upper end of the sheet supported by the matching member protrudes to an outside of the frame.

5. The sheet post-processing apparatus according to claim 1, wherein the matching member includes a back plate portion that extends along the guide member, and a receiving portion that protrudes from the back plate portion and that receives the lower end of the sheet, and the support member includes a main plate portion that is superposed on a back surface of the back plate portion when the support member is attached to the matching member.

6. The sheet post-processing apparatus according to claim 5, wherein the back plate portion is provided with an engagement portion, the support member is provided with an engagement receiving portion configured to detachably engage with the engagement portion, and the engagement portion is removed from the engagement receiving portion when the matching member is raised with respect to the support member.

7. The sheet post-processing apparatus according to claim 6, wherein the engagement receiving portion includes a recess formed upward, and the engagement portion includes:

a shaft portion that protrudes from the back plate portion and that is inserted into the recess, and a restriction portion that has a diameter larger than that of the shaft portion and that restricts the engagement receiving portion from moving in a direction away from the back plate portion.

8. The sheet post-processing apparatus according to claim 5, wherein the matching member further includes an operation portion that protrudes from the back plate portion, and when the support member is attached to the matching member, the operation portion protrudes further toward a back surface side than a back surface of the main plate portion.

9. The sheet post-processing apparatus according to claim 8, wherein the operation portion has a stick shape that linearly protrudes from the back plate portion.

10. The sheet post-processing apparatus according to claim 1, wherein the guide member is inclined such that the loading surface faces obliquely upward.

11. A method of sheet post-processing, comprising:

loading a sheet on a loading surface of a guide member in a standing state;

supporting a lower end of the sheet loaded on the guide member in a free raising and lowering manner with a matching member;

post-processing the sheet;

supporting the matching member with a support member;

raising and lowering the support member with a drive component; and raising and lowering the matching member with respect to the support member.

12. The method according to claim 11, wherein post-processing includes:

folding the sheet in half with a blade by pushing the sheet supported by the matching member into a nip portion of a pair of folding rollers.

13. The method according to claim 12, further comprising:

switching the matching member between a normal position at which a folding operation of the sheet by the blade is executable and a raised position higher than the normal position.

14. An image forming apparatus, comprising:

an image forming components; and a sheet post-processing apparatus, comprising:

a guide member having a loading surface on which a sheet is loaded in a standing state;

a matching member configured to support a lower end of the sheet loaded on the guide member in a free raising and lowering manner;

a post-processing mechanism configured to perform post-processing on the sheet;

a support member configured to support the matching member; and a drive component configured to raise and lower the support member, wherein the matching member is configured to be raised and lowered with respect to the support member.

15. The image forming apparatus according to claim 14, wherein the post-processing mechanism includes:

a pair of folding rollers, and a blade configured to fold the sheet in half by pushing the sheet supported by the matching member into a nip portion of the folding rollers.

16. The image forming apparatus according to claim 15, wherein the matching member is configured to switch between a normal position at which a folding operation of the sheet by the blade is executable and a raised position higher than the normal position.

17. The image forming apparatus according to claim 16, further comprising:

a frame on which the guide member, the matching member, the folding rollers, the blade, the support member, and the drive component are mounted, wherein when the matching member is at the normal position, the sheet supported by the matching member is located in the frame, and when the matching member is at the raised position, a portion including an upper end of the sheet supported by the matching member protrudes to an outside of the frame.

18. The image forming apparatus according to claim 14, wherein the matching member includes a back plate portion that extends along the guide member, and a receiving portion that protrudes from the back plate portion and that receives the lower end of the sheet, and the support member includes a main plate portion that is superposed on a back surface of the back plate portion when the support member is attached to the matching member.

19. The image forming apparatus according to claim 18, wherein the back plate portion is provided with an engagement portion, the support member is provided with an engagement receiving portion configured to detachably engage with the engagement portion, and the engagement portion is removed from the engagement receiving portion when the matching member is raised with respect to the support member.

20. The image forming apparatus according to claim 19, wherein the engagement receiving portion includes a recess formed upward, and the engagement portion includes:

a shaft portion that protrudes from the back plate portion and that is inserted into the recess, and a restriction portion that has a diameter larger than that of the shaft portion and that restricts the engagement receiving portion from moving in a direction away from the back plate portion.

* * * * *